US011621107B2

(12) United States Patent
Noll et al.

(10) Patent No.: US 11,621,107 B2
(45) Date of Patent: Apr. 4, 2023

(54) RESISTOR ASSEMBLY AND METHOD FOR PRODUCING SAME

(71) Applicant: Wieland-Werke AG, Ulm (DE)

(72) Inventors: Tony Robert Noll, Dietenheim (DE); Gerhard Thumm, Erbach (DE); Volker Voggeser, Senden (DE); Kim-Oliver Guther, Ulm (DE); Felix Schulz, Ulm (DE); Philipp-Morris Egle, Erbach (DE); Michael Wolf, Ulm (DE); Christoph Kästle, Ulm (DE); Jochen Walliser, Ulm (DE)

(73) Assignee: WIELAND-WERKE AG, Ulm (DE)

( * ) Notice: Subject to any disclaimer, the term of this patent is extended or adjusted under 35 U.S.C. 154(b) by 0 days.

(21) Appl. No.: 17/533,457

(22) Filed: Nov. 23, 2021

(65) Prior Publication Data

US 2022/0189664 A1 Jun. 16, 2022

(30) Foreign Application Priority Data

Dec. 10, 2020 (DE) ..... 102020007556.8

(51) Int. Cl.
*H01C 1/144* (2006.01)
*H01C 17/28* (2006.01)

(52) U.S. Cl.
CPC ..... *H01C 1/144* (2013.01); *H01C 17/28* (2013.01)

(58) Field of Classification Search
CPC ..... H01C 1/144; H01C 17/28
See application file for complete search history.

(56) References Cited

U.S. PATENT DOCUMENTS 4,309,687 A * 1/1982 Utner ..... G01L 1/2287 338/2
5,214,407 A * 5/1993 McKim, Jr. ..... H01C 17/24 338/195
5,621,240 A * 4/1997 Ellis ..... H01C 17/22 257/536
8,884,733 B2 11/2014 Hetzler
9,934,893 B2 * 4/2018 Murakami ..... H01C 17/22
(Continued)

FOREIGN PATENT DOCUMENTS

DE 1228341 11/1966
DE 2916425 B1 7/1980
(Continued)

OTHER PUBLICATIONS

European Search Report issued in corresponding European Application No. 21000320.8 with English translation of categories of cited documents, dated Sep. 14, 2022 (13 pages).
(Continued)

*Primary Examiner* — Kyung S Lee
(74) *Attorney, Agent, or Firm* — Flynn Thiel, P.C.

(57) ABSTRACT

A resistor assembly including at least two connector elements and at least one strip-like or plate-like resistor element arranged between the connector elements. The resistor element has an upper side, a lower side and two longitudinal sides parallel to each other. The at least one resistor element is of a material of which the electrical conductivity is lower than the electrical conductivity of the material of the connector elements. The resistor element has, on at least its upper side or at least its lower side, at least one shaped element as a positioning aid.

18 Claims, 5 Drawing Sheets

(56) References Cited

U.S. PATENT DOCUMENTS

| | | | | |
|---|---|---|---|---|
| 10,163,553 | B2 * | 12/2018 | Kameko | H01C 17/28 |
| 11,187,724 | B2 * | 11/2021 | Tsukahara | H01C 1/14 |
| 2010/0066351 | A1 | 3/2010 | Condamin et al. | |
| 2011/0057764 | A1 * | 3/2011 | Smith | H01C 17/232 338/25 |
| 2015/0212115 | A1 * | 7/2015 | Nakamura | G01R 1/203 338/332 |

FOREIGN PATENT DOCUMENTS

| | | | |
|---|---|---|---|
| DE | 2939594 | A1 | 4/1981 |
| DE | 10204669 | A1 | 11/2002 |
| DE | 102011120276 | A1 | 6/2013 |
| EP | 0605800 | A1 | 7/1994 |
| EP | 2446449 | B1 | 5/2012 |
| EP | 3674716 | A1 | 7/2020 |
| JP | 2008182078 | A | 8/2008 |
| KR | 1020170104828 | A | 9/2017 |
| WO | 2011028870 | A1 | 3/2011 |

OTHER PUBLICATIONS

German Office Action issued in corresponding German Application No. 10 2020 007 556.8 dated Oct. 27, 2021 (7 pages).
Partial European Search Report issued in corresponding European Application No. 21000320.8, dated May 16, 2022 (13 pages).

* cited by examiner

RESISTOR ASSEMBLY AND METHOD FOR PRODUCING SAME

CROSS-REFERENCE TO RELATED APPLICATION

This claims priority from German Application No. 10 2020 007 556.8, filed Dec. 10, 2020, the disclosure of which is hereby incorporated by reference in its entirety.

TECHNICAL FIELD

The invention relates to a resistor assembly for measuring current intensity and to methods for producing such a resistor assembly.

BACKGROUND AND SUMMARY

For current measurement in electronic circuits, measuring resistors are used which are connected in series to the component to be monitored. The current intensity is determined here from the voltage that drops across the measuring resistor, which is referred to as a shunt resistor. The resistance value of such a low-resistance measuring resistor is typically 10 to 50 μOhm. The correct and reliable measurement of the current intensity is, for example, particularly important in a battery management system of an electric or hybrid vehicle.

A resistor assembly for measuring current intensity comprises at least two connector elements which serve to connect the resistor assembly to an external circuit, and at least one resistor element which is arranged between the connector elements with respect to the current flow direction. Such a resistor assembly can be made or produced from a longitudinal seam welded material composite. This is known, for example, from document EP 0 605 800 A1. The material composite is produced from three metal strips by connecting the individual metal strips to each other via a longitudinal seam by an electron beam or laser welding process.

The material of the resistor element has a higher resistivity than the material of the connector elements. Furthermore, the resistivity of the material of the resistor element is hardly dependent on temperature, whereas the resistivity of the material of the connector elements has a significant temperature dependence.

Usually, the voltage dropping across the measuring resistor is detected by means of measuring taps which are attached to or on the connector elements on both sides of the resistor element. This has the advantage that the magnitude of the resistance value is predominantly determined by the easily controllable geometry of the resistor element and only to a much lesser extent by the position of the measuring taps on the highly conductive connector elements. However, the temperature dependence of the resistance of the material of the connector elements has a non-negligible influence on the measurement signal with this method. In order to avoid this influence, it is proposed, for example, in documents EP 2 446 449 B1 and WO 2011/028 870 A1, to change the curvature of the equipotential lines by means of suitable incisions or slits in the connector elements, in such a way that the temperature influence on the measurement signal is minimized.

The temperature influence of the connector elements on the measurement signal can be completely eliminated by tapping the voltage directly at the resistor element. However, this requires the voltage taps to be positioned very precisely on the resistor element in order to maintain the specified resistance value and thus achieve the desired measurement accuracy. Furthermore, in some applications it is necessary to measure the voltage that drops across a part of the measuring resistor in addition to the voltage that drops across the measuring resistor as a whole. For this purpose, at least one voltage tap must be positioned very precisely at a predetermined point on the resistor element in order to achieve the required measurement accuracy.

The object of the invention is therefore to specify a resistor assembly with improved measuring accuracy and a method for producing same. Furthermore, it should be possible to produce the resistor assembly economically.

The invention includes a resistor assembly for measuring current intensity, comprising at least two connector elements and at least one resistor element which is arranged between the connector elements and has a strip-like or plate-like main body. The resistor element has an upper side, a lower side parallel to the upper side and two longitudinal sides running parallel to each other. The distance between the upper side and the lower side defines the thickness D of the resistor element. The distance between the two longitudinal sides defines the width B of the resistor element. The extension of the resistor element in the direction of the longitudinal sides and perpendicular to its thickness defines the length L of the resistor element. In many cases, the resistor element is dimensioned such that L>B>D. The at least one resistor element consists of a material of which the electrical conductivity is lower than the electrical conductivity of the material of the connector elements. According to the invention, the resistor element has, on its upper side or on its lower side or both on its upper side and on its lower side, at least one shaped element as a positioning aid.

The resistor assembly described above can comprise a low-resistance shunt resistor as a resistor element. The connector elements of the resistor assembly can be made of copper, a preferably low-alloy copper alloy, aluminum or a preferably low-alloy aluminum alloy, or can comprise at least one of these materials. The resistor element can consist of a copper alloy commonly used as a resistance alloy. The resistivity of the resistance alloy is greater than the resistivity of the material of the connector elements. Further, the resistor element material has a resistivity that varies substantially less with temperature than the resistivity of the material of the connector element.

The connector elements of the resistor assembly serve to incorporate the resistor assembly into an external circuit. For this purpose, the connector elements can each have at least one connection means. Such a connection means can be, for example, a bore with or without an internal thread or a pressed-in bolt. The resistor element can be electrically conductively connected, preferably welded, to connector elements, one on each of its longitudinal sides. The connector elements can be terminal connector elements of the resistor assembly. However, it is also possible that at least one connector element is arranged between two resistor elements with respect to a possible current path. By positioning the connector elements and the resistor element relative to each other, a current flow direction that is substantially perpendicular to the longitudinal sides of the resistor element is defined in the resistor element.

The resistor assembly can be formed in a planar assembly. In this case, the connector elements and the at least one resistor element are formed as plate-like or strip-like elements and are arranged in a plane next to each other, preferably in a row. The thickness D of a resistor element can be arbitrary in relation to the thickness of the connector elements. However, it is usually not greater than the thickness of the connector elements.

In the context of this invention, a shaped element is understood to be any targeted shape change that represents a deviation from the geometrically flat surface and that is suitable for defining a specific position on the upper side or lower side of the resistor element, at least in one spatial direction. The extension of the shape change is locally limited here, at least in the direction along the current flow direction, in order to define a position with respect to this direction. The shaped element thus defines at least one region that extends transversely to the current flow direction. The shaped element can also define a nearly point-like location. For example, a shaped element can be a depression in the upper side or in the lower side of the resistor element or an elevation above the otherwise flat surface of the upper side or lower side of the resistor element. In the case of an elevation, the material of the elevation is preferably monolithically bonded to the material of the resistor element.

The shaped element is a positioning aid when contacting an electrical conductor, in particular when positioning the end of an electrical conductor. The electrical conductor can be, for example, a wire, a metal post or a pin. In the case of a raised shaped element, the conductor can also be a conductor track of a printed circuit board. The electrical conductor or the end of the electrical conductor can preferably be connected in an integrally bonded manner to the resistor element, for example by welding or soldering. The electrical conductor serves as a measuring tap for determining the electrical voltage that drops across at least part of the resistor element.

The particular advantage of the resistor assembly described above is that the shaped element can be used as a positioning aid for attaching a measuring tap. The shaped element can already be inserted into the resistor element with very high positional accuracy during the production of the resistor assembly. This high positional accuracy is transferred to the position of the measuring tap, so that its position on the resistor element is also very precisely predetermined. Because the position of the measuring tap determines the size of the resistor used for voltage measurement, the size of this resistor can also be predetermined very precisely in this way.

The shaped element can also serve, for example, as a positioning aid for an optically supported positioning system. Here, an optical sensor, for example a camera, detects the position of the shaped element on the resistor element. The position of the shaped element then serves as a reference for attaching the measuring tap to the surface of the resistor element.

Furthermore, the shaped element can also be used to contact the electrical conductor. In this case, the electrical conductor contacts the resistor element via the shaped element.

The at least one shaped element can be introduced during the production of the strip from which the resistor element is formed, for example by a drawing operation or a rolling operation. Preferably, the insertion of the shaped element into the strip takes place after the processing step in which the width of the strip is set. In this way, a high accuracy of the position of the shaped element on the resistor element is achieved. Alternatively, it is also possible, to first introduce the shaped element into the strip and to then set the final width of the strip. In this case, the shaped element serves as a reference on the basis of which the distance of each of the longitudinal sides of the strip to the shaped element can be determined.

Preferably, the shaped element can extend parallel to the longitudinal sides of the resistor element and over the entire length L thereof. Such a shaped element can be particularly easily introduced during the production of the strip from which the resistor element is formed, for example by a drawing process.

Preferably, the resistor element has at least two shaped elements. By means of measuring taps, which are positioned on the resistor element with the help of these shaped elements, the voltage which drops along the current path between these two contact points can be tapped. Because the measuring taps are positioned on the resistor element and not on the connector elements, the temperature influence on the resistance value caused by the material of the connector elements is completely eliminated. The resistance value remains almost constant even with changing temperature. Particularly preferably, the shaped elements are positioned close to one each of the two longitudinal sides of the resistor element. In this case, almost the entire voltage dropping across the resistor element is detected by the measuring taps. The measured signal is then at a maximum, whereby relative measurement uncertainties are minimized.

The electrical resistivity of the resistor element material can vary from batch to batch. In prior art resistor assemblies in which the voltage taps are positioned on the connector elements, this variation is compensated for by trimming the resistor element in a subsequent processing step, i.e., adjusting its length L. In a resistor assembly according to the invention, the variation of the resistivity can be compensated for without this trimming by adjusting the spacing of the measuring taps on the resistor element accordingly. For this purpose, the position of at least one shaped element on the resistor element is deliberately changed with respect to the current flow direction, so that a measuring resistor with a specific, predetermined resistance value is produced. The smaller the distance between two measuring taps measured relative to the current flow direction, the smaller the resistance in the resistor element between the measuring taps. In this way, measuring resistors with different resistance values can also be produced with the same width and thickness of the resistor element.

In a particular embodiment, the resistor element has at least three shaped elements. Three or more measuring taps can then be positioned very precisely on the resistor element. Redundant voltage measurements can then be carried out on such a resistor element, which increases the certainty and reliability of the measurement.

Within the scope of one embodiment, the at least one shaped element can be a recess in the material of the resistor element for receiving an end of an electrical conductor. In particular, the recess can be a depression in the material of the resistor element, the depression extending only over part of the thickness D of the resistor element. Examples include a blind bore, a notch, a dimple, a punching or a groove. Such indentations can be made, for example, by stamping or cutting. The end of an electrical conductor can be accommodated particularly well in a recess, so that the conductor can be accurately positioned particularly easily and securely.

Within the scope of a particular variant of this embodiment, the recess can be a groove which extends parallel to the longitudinal sides of the resistor element and preferably over its entire extent in the longitudinal direction, i.e., over its entire length L. Such a groove can be produced particularly easily during the production of the strip from which the resistor element is formed, for example by a drawing process or rolling process.

Within the scope of a particularly advantageous variant of this embodiment, the groove can have a V-shaped cross-section. In a V-shaped groove, the end of the conductor can center itself so that a high accuracy of the position is securely achieved.

Within the scope of a further variant of this embodiment, the recess can be at least partially filled with solder. This makes it possible for the end of the electrical conductor to be soldered to the resistor element at a precisely defined position.

Within the scope of an alternative embodiment, the at least one shaped element can have a region which is raised above the upper side or the lower side of the resistor element, and the shaped element can be at least partially coated with solder in this region. In particular, the region of the shaped element furthest from the upper side or the lower side of the resistor element can be coated here with solder. This region can be, for example, the surface of the resistor element that is furthest away from the upper side or lower side of the resistor element. In this embodiment, for example, a conductor track of a printed circuit board can be soldered to the shaped element without additional effort.

In a further advantageous variant of the invention, a shaped element can be arranged centrally between the longitudinal sides of the resistor element. This enables the precise positioning of a measuring tap in the center of the resistor element. With such a centrally positioned measuring tap, the voltage across half the resistor element can be tapped. Together with a voltage measurement over the entire resistor element, two or even three redundant measurement signals are provided, from the comparison of which the reliability of the measurement can be assessed.

With regard to further technical features and advantages of the resistor assembly, reference is hereby explicitly made to the explanations in conjunction with the methods for producing a resistor assembly described below, as well as to the figures, the description of the figures, and the exemplary embodiments.

A further aspect of the invention includes a method for producing a resistor assembly as described above, wherein the method comprises the following steps:

a) providing a first strip made of a first material, the strip having an upper side and a lower side as well as two longitudinal sides which are parallel to each other, b) setting the width B of the first strip, measured between the two longitudinal sides, by machining the longitudinal sides, c) introducing at least one shaped element into at least the upper side or at least the lower side of the first strip, d) longitudinal seam welding the first strip on each of its two longitudinal sides with a further strip made of a material of which the electrical conductivity is greater than the electrical conductivity of the first material, thus forming a strip-like material composite, e) cutting the strip-like material composite formed in step d) to produce a resistor assembly, a resistor element of the resistor assembly being formed from the material of the first strip.

With regard to the terms used to describe the method, reference is hereby explicitly made to the above explanations of the terms in connection with the description of the resistor assembly.

The first strip consists of a material with an electrical conductivity that is hardly dependent on temperature. The other strips, which are welded to the first strip, each consist of a material of which the electrical conductivity has a significant dependence on temperature. Connector elements of the resistor assembly can be formed from the material of the two further strips.

In method step b), the width B of the first strip is set. This can be done by trimming, for example by milling, the longitudinal sides of the strip. After the width of the first strip has been fixed, in method step c) at least one shaped element is introduced into the upper side or into the lower side or into both the upper side and the lower side of the strip. The shaped element can be introduced, for example, by an embossing step, by machining or preferably by a drawing or rolling operation.

The particular advantage of the method lies in the fact that the at least one shaped element is introduced into the upper side and/or lower side of the first strip only after the width B of the strip has been set. Thus, the shaped element can be positioned very precisely with respect to the edges of the strip defined by the longitudinal sides. Correspondingly, in a later processing step, the end of an electrical conductor can be precisely positioned on the resistor element with the help of the shaped element.

The method steps c) and d) can also be carried out in reverse order.

The cutting in step e) is preferably carried out transversely to the longitudinal direction of the strip-like material composite, i.e., in particular transversely to the longitudinal direction of the first strip.

A further aspect of the invention includes an alternative method for producing a resistor assembly as described above, wherein the method comprises the following steps:

a) providing a first strip made of a first material, the strip having an upper side and a lower side as well as two longitudinal sides, and the first strip having, at least on its upper side or at least on its lower side, at least one shaped element, b) setting the width B of the first strip, measured between the two longitudinal sides, by machining the longitudinal sides, c) longitudinal seam welding the first strip on each of its two longitudinal sides with a further strip made of a material of which the electrical conductivity is greater than the electrical conductivity of the first material, thus forming a strip-like material composite, d) cutting the strip-like material composite formed in step c) to produce a resistor assembly, a resistor element of the resistor assembly being formed from the material of the first strip.

With regard to the terms used to describe the alternative method, reference is hereby explicitly made to the above explanations of the terms in conjunction with the description of the resistor assembly.

The first strip consists of a material with an electrical conductivity that is hardly dependent on temperature. The other strips, which are welded to the first strip, each consist of a material of which the electrical conductivity has a significant dependence on temperature. Connector elements of the resistor assembly can be formed from the material of the two further strips.

The first strip has, on its upper side or its lower side or both on its upper side and on its lower side, at least one shaped element.

The shaped element can extend continuously along the entire length of the strip. For example, in this case the shaped element can be a depression in the form of a longitudinal groove or an elevation in the form of a longitudinal rib. Shaped elements that extend continuously along the entire length of the strip can be created particularly advantageously already during the production of the strip.

This can be achieved in particular by means of a drawing process or a rolling process in which a corresponding tool is used for shaping. By cutting the strip-like material in step d), resistor assemblies with one resistor element each are formed. The resistor elements have a shaped element which extends over the entire length of a resistor element.

Alternatively, the at least one shaped element can be formed as a shaped element limited in the longitudinal direction of the belt. In this case, the shaped element can be, for example, a local recess in the form of a conical depression or a local elevation in the form of a cylinder or a truncated cone. The first strip then has a plurality of such shaped elements arranged along a row at a repeating spacing over the entire length of the strip. Such shaped elements can be introduced into the strip, for example, by an embossing process. In the case of shaped elements of which the extension in the longitudinal direction of the strip is limited, the cutting of the strip-like material composite in step d) is carried out in such a way that the resistor element of each resistor assembly has at least one shaped element.

In method step b), the width B of the first strip is set. This can be done by trimming, for example by milling, the longitudinal sides of the strip. The particular advantage of the method is that the position of the shaped element on the first strip can be detected very precisely by means of suitable sensors. This makes it possible to determine the width of the first strip in such a way that the shaped element has a specific position in relation to the width of the first strip. In particular, the strip can be trimmed so that the shaped element, after step b), is positioned exactly centrally between the longitudinal sides of the first strip.

The cutting in step d) is preferably carried out transversely to the longitudinal direction of the strip-like material composite, i.e., in particular transversely to the longitudinal direction of the first strip.

With regard to further technical features and advantages of the two methods described above, reference is hereby explicitly made to the explanations in conjunction with the resistor assembly according to the invention as well as to the figures, the description of the figures and the exemplary embodiments. In particular, reference is made to the embodiments described therein with regard to the shape, position and number of the shaped elements.

Exemplary embodiments of the invention are explained in greater detail with reference to the schematic drawings.

DETAILED DESCRIPTION

Corresponding parts are provided with the same reference signs in all figures.

Figure 1:
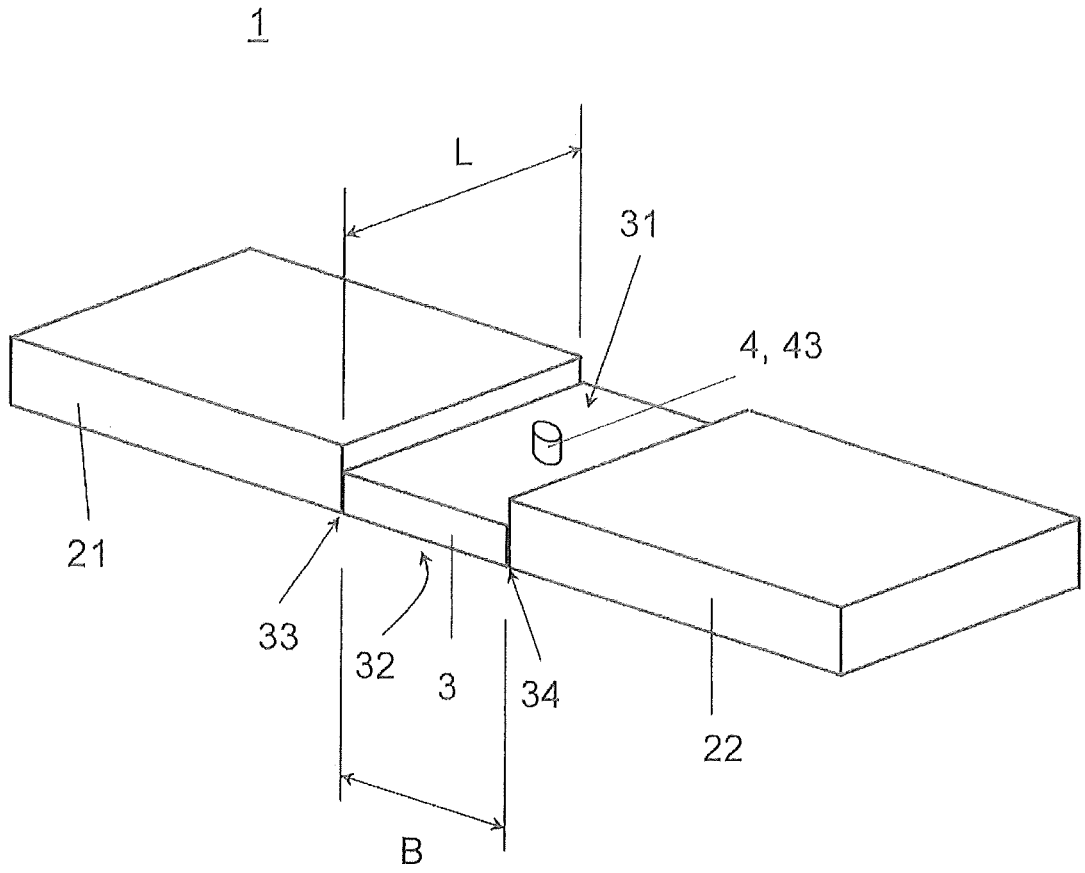
FIG. 1 shows an oblique view of a resistor assembly with a shaped element.
Figure 2:
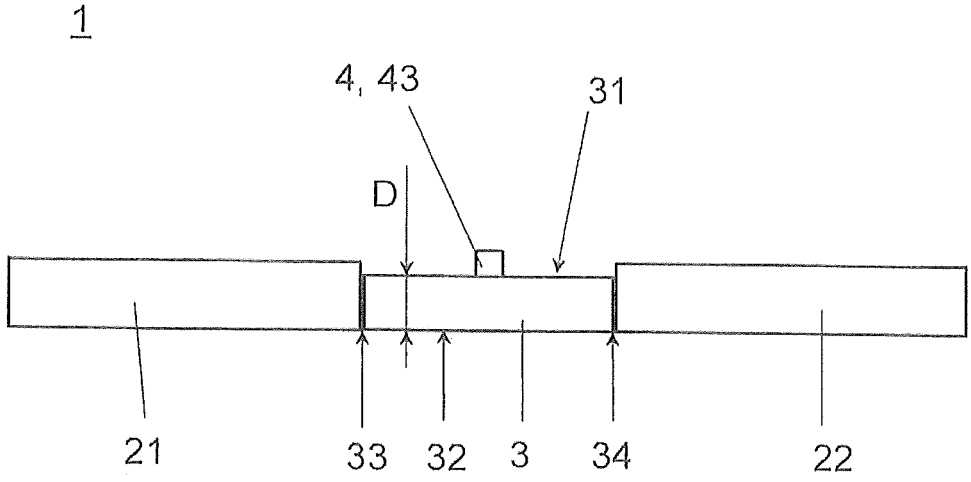
FIG. 2 shows a side view of the resistor assembly according to FIG. 1.

FIG. 1 shows an oblique view of a resistor assembly 1 with a shaped element 4. FIG. 2 shows a side view of the resistor assembly according to FIG. 1. The resistor assembly 1 comprises two connector elements 21, 22. A resistor element 3 is arranged between the connector elements 21, 22 and has a main body in the form of a strip or plate. The resistor element 3 has a substantially flat upper side 31 and a substantially flat lower side 32 opposite the upper side. It has a thickness D, a length L and a width B. These dimensions are defined as shown in the figures. The resistor element 3 is electrically conductively connected to connector elements 21, 22, one on each of its two longitudinal sides 33, 34. This defines in the resistor element 3 a current flow direction which is oriented perpendicular to the two longitudinal sides 33, 34, i.e., along the width direction. The connector elements 21, 22 can have connection means for incorporating the resistor assembly 1 into an external circuit. These connection means are not shown for reasons of clarity.

On its upper side 31, the resistor element 3 has a centrally arranged shaped element 4, which is formed as a local cylindrical elevation 43. Alternatively, the elevation 43 can also be formed as a cone or truncated cone. The elevation 43 is limited both in the current flow direction and transversely to the current flow direction. The size of the shaped element 4 is not shown to scale within the resistor assembly 1. By means of the shaped element 4, 43, a position is defined on the upper side 31 of the resistor element 3, at which position the end of an electrical conductor, not shown, can be attached. Preferably, the height of the elevation 43 is selected such that the elevation 43 has a region that protrudes beyond the two connector elements 21, 22. This facilitates, for example, the contacting of a conductor track of a printed circuit board. The surface of the shaped element 4, 43 facing away from the resistor element 3 can be coated with solder. This simplifies the subsequent soldering of a conductor track.

Figure 3:
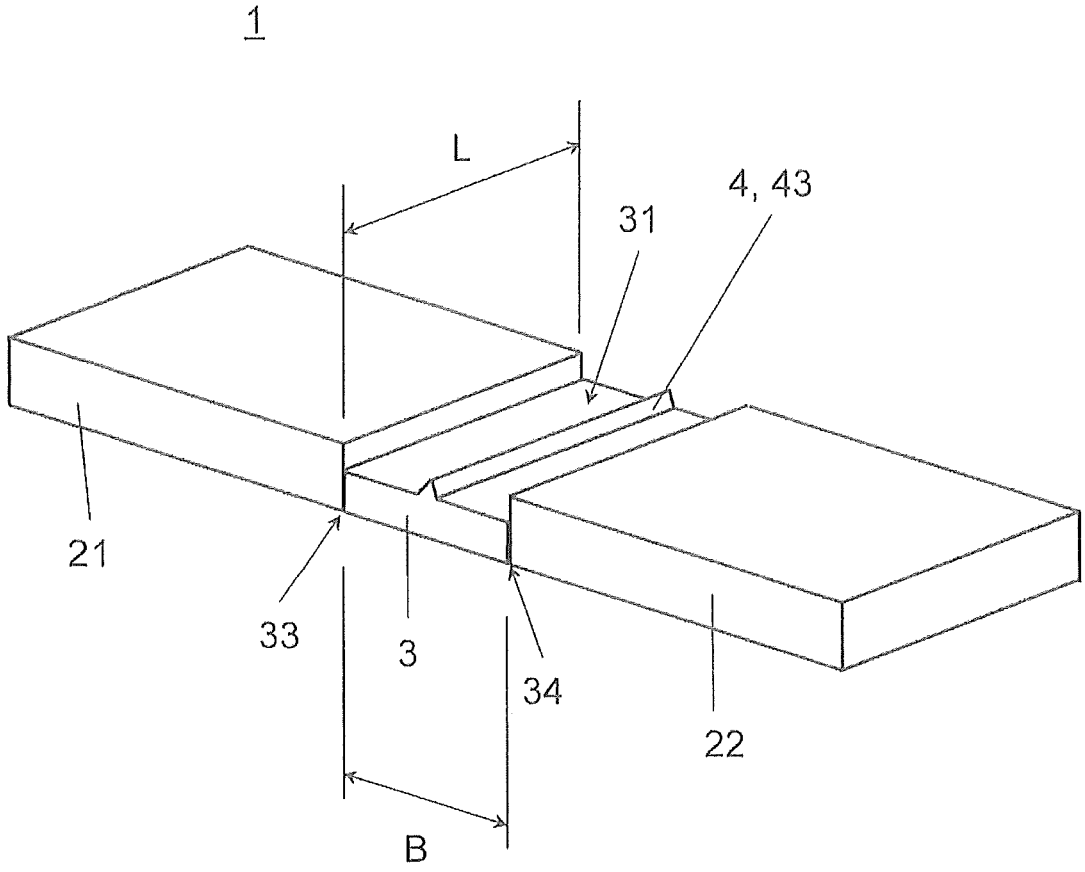
FIG. 3 shows an oblique view of a resistor assembly with an alternative shaped element.
Figure 4:
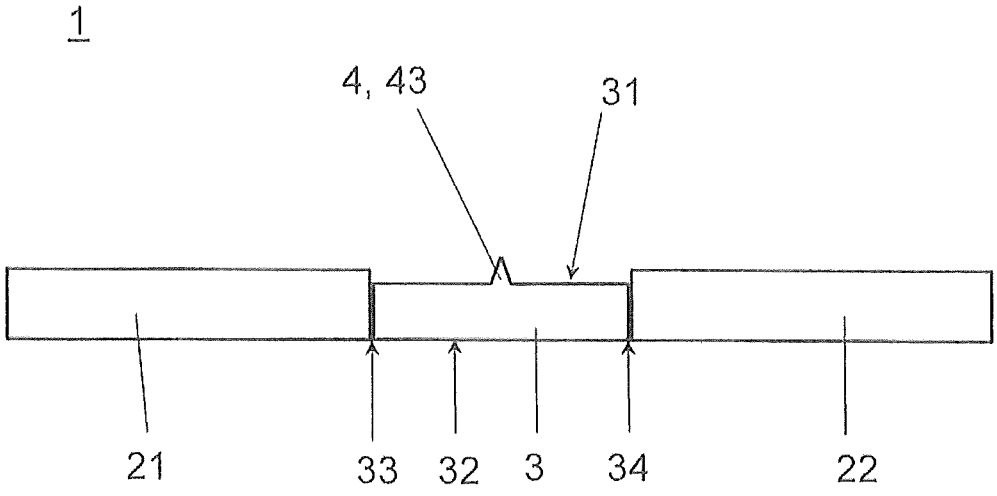
FIG. 4 shows a side view of the resistor assembly according to FIG. 3.

FIG. 3 shows an oblique view of a resistor assembly 1 with an alternative shaped element 4. FIG. 4 shows a side view of the resistor assembly according to FIG. 3. The resistor element 3 is electrically conductively connected to connector elements 21, 22, one on each of its two longitudinal sides 33, 34. This defines in the resistor element 3 a current flow direction which is oriented perpendicular to the two longitudinal sides 33, 34, i.e., along the width direction. The connector elements 21, 22 can have connection means for incorporating the resistor assembly 1 into an external circuit. These connection means are not shown for reasons of clarity.

On its upper side 31, the resistor element 3 has a shaped element 4, which is formed as an elevation 43. The elevation 43 extends in the form of a triangular profile or a ridge parallel to the two longitudinal sides 33, 34 over the entire length L of the resistor element 3. The elevation 43 is thus spatially limited in the current flow direction, but not transversely to the current flow direction. By way of its spatial limitation in the current flow direction, the shaped element 4, 43 defines a region which serves as a positioning aid for the end of an electrical conductor. Preferably, the height of the elevation 43 is selected such that the elevation 43 has a region that protrudes beyond the two connector elements 21, 22.

Figure 5:
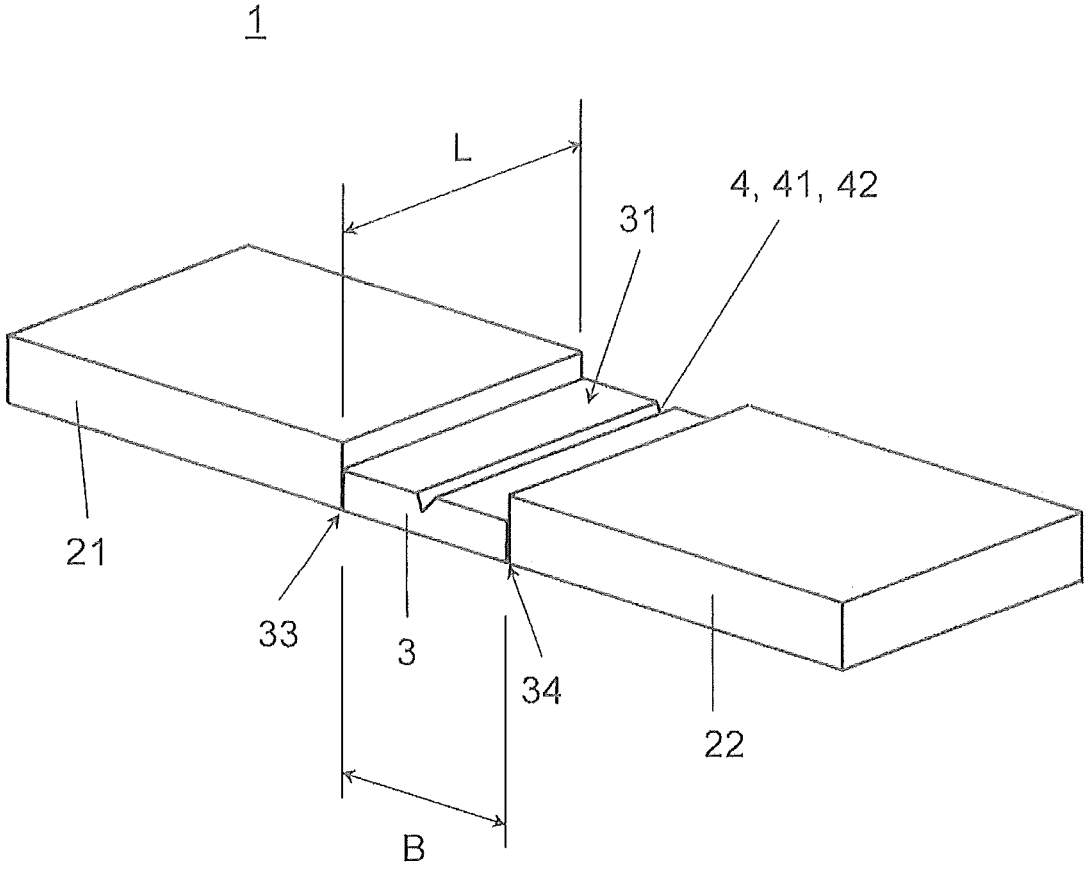
FIG. 5 shows an oblique view of a resistor assembly with a groove.
Figure 6:
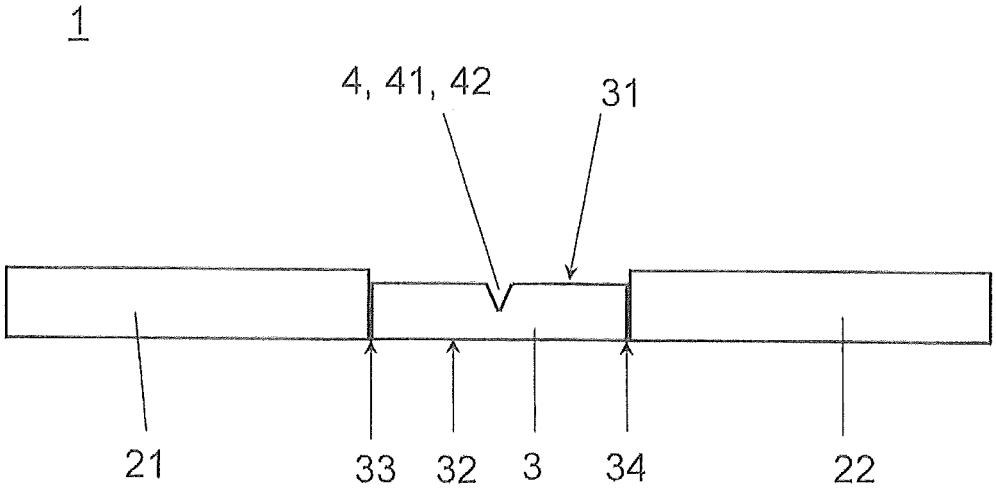
FIG. 6 shows a side view of the resistor assembly according to FIG. 5.

FIG. 5 shows an oblique view of a resistor assembly 1 with a further alternative shaped element 4. FIG. 6 shows a side view of the resistor assembly according to FIG. 5. The resistor element 3 is electrically conductively connected to connector elements 21, 22, one on each of its two longitudinal sides 33, 34. This defines in the resistor element 3 a current flow direction which is oriented perpendicular to the two longitudinal sides 33, 34, i.e., along the width direction. The connector elements 21, 22 can have connection means for incorporating the resistor assembly 1 into an external circuit. These connection means are not shown for reasons of clarity.

On its upper side 31, the resistor element 3 has a shaped element 4, which is formed as a recess 41 in the material of the resistor element 3. The recess 41 is embodied as a V-shaped groove 42 and is arranged centrally between the two longitudinal sides 33, 34 of the resistor element 3. The groove 42 extends parallel to the two longitudinal sides 33, 34 over the entire length L of the resistor element 3. The groove 42 is thus spatially limited in the current flow direction, but not transverse to the current flow direction. Due to its spatial limitation in the current flow direction, the groove 42 defines a region that serves as a positioning aid for the end of an electrical conductor. The V-shaped cross-section allows the end of the electrical conductor to be centered. Thus, a very precise positioning of the measuring tap can be achieved.

Figure 7:
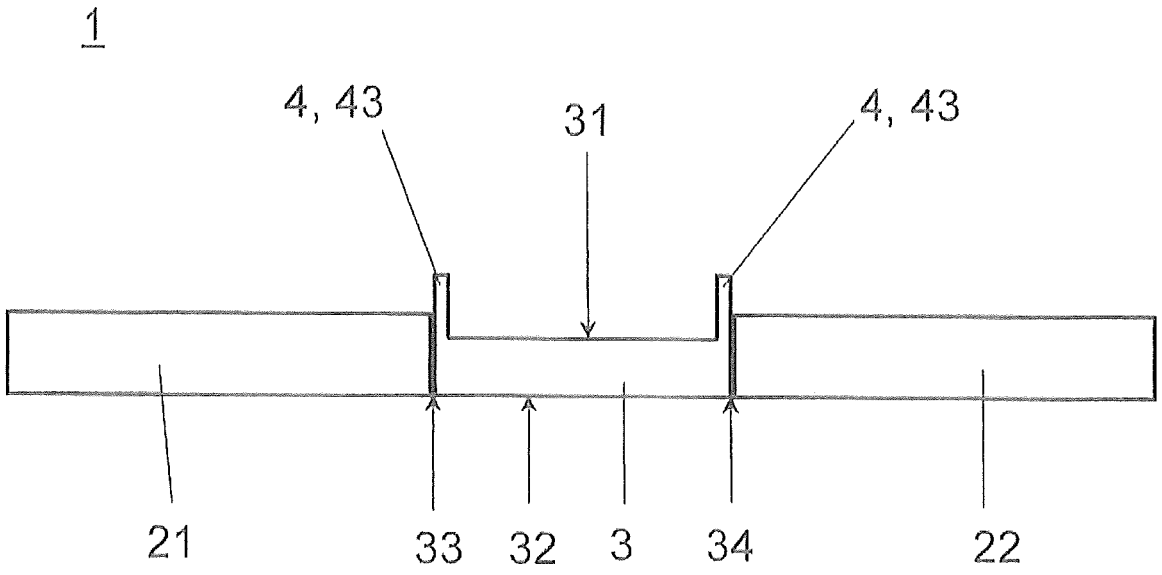
FIG. 7 shows a side view of a resistor assembly with two shaped elements.

FIG. 7 shows a side view of a preferred embodiment of a resistor assembly 1. The resistor element 3 is electrically conductively connected to connector elements 21, 22, one on each of its two longitudinal sides 33, 34. This defines in the resistor element 3 a current flow direction which is oriented perpendicular to the two longitudinal sides 33, 34, i.e., along the width direction. The resistor element 3 has, on its surface 31, two shaped elements 4 embodied as an elevation 43, each of which is arranged close to one of the two longitudinal sides 33, 34 of the resistor element 3. The height of each of the elevations 43 is selected such that the elevations 43 each have a region which projects beyond the two connector elements 21, 22. The shaped elements 4 are each formed as a narrow rectangular profile and extend parallel to the two longitudinal sides 33, 34 over the entire length of the resistor element 3. The elevations 43 are thus spatially limited in the current flow direction, but not transverse to the current flow direction. Due to their spatial limitation in the current flow direction, the shaped elements 4, 43 each define a region that serves as a positioning aid for the end of an electrical conductor. Thus, the voltage dropping exclusively across the resistor element 3 can be detected, without this voltage signal being influenced by additional partial voltages caused by the resistance of the connector elements 21, 22. Since the electrical resistance of the resistor element 3, unlike the resistance of the connector elements 21, 22, does not vary with temperature, the resistor assembly shown in FIG. 7 makes it possible to very precisely determine the current intensity from the measured voltage, even with changing temperature. The surface of the shaped elements 4, 43 facing away from the resistor element 3 can be at least partially coated with solder.

Figure 8:
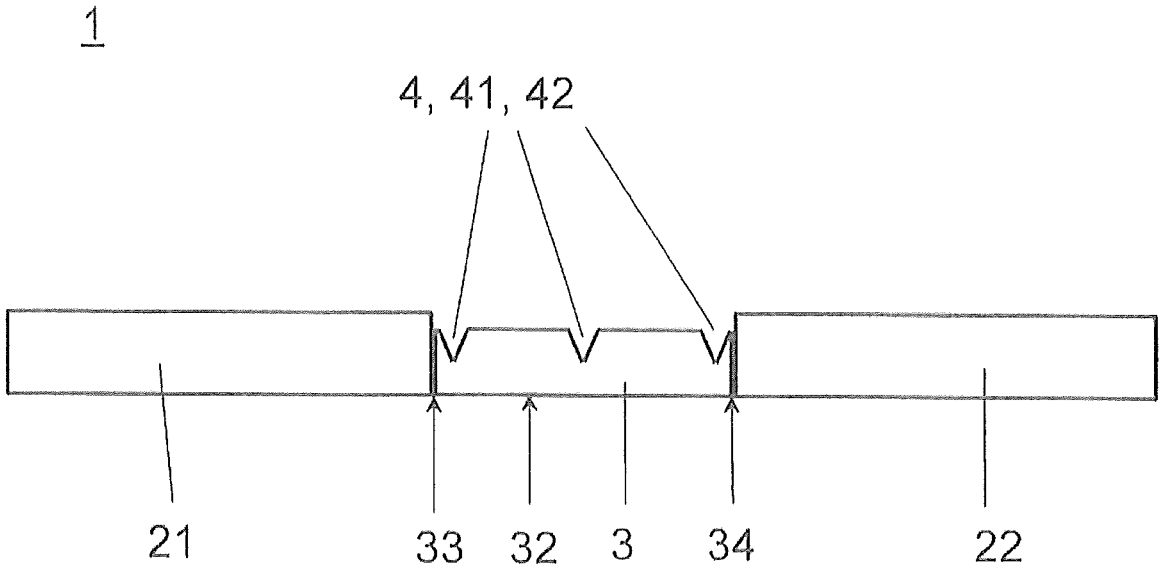
FIG. 8 shows a side view of a resistor assembly with three shaped elements.

FIG. 8 shows a side view of a particularly preferred embodiment of a resistor assembly 1. The resistor element 3 has three recesses 41 in the form of V-shaped grooves 42 on its surface 31. The grooves 42 each extend parallel to the two longitudinal sides 33, 34 over the entire length of the resistor element 3. The two grooves 42 located outermost (in the width direction of the resistor element 1) are each arranged close to one of the longitudinal sides 33, 34 of the resistor element 3. The third groove 42 is arranged centrally between the two longitudinal sides 33, 34. The grooves 42 serve as a positioning aid for measuring taps. By means of such measuring taps, both the voltage dropping across the entire resistor element 3 and the two partial voltages each dropping across one half of the resistor element 3 can be detected in the illustrated resistor assembly 1. By comparing the current intensity determined from the various voltages, the reliability of the measurements can be assessed.

Figure 9:
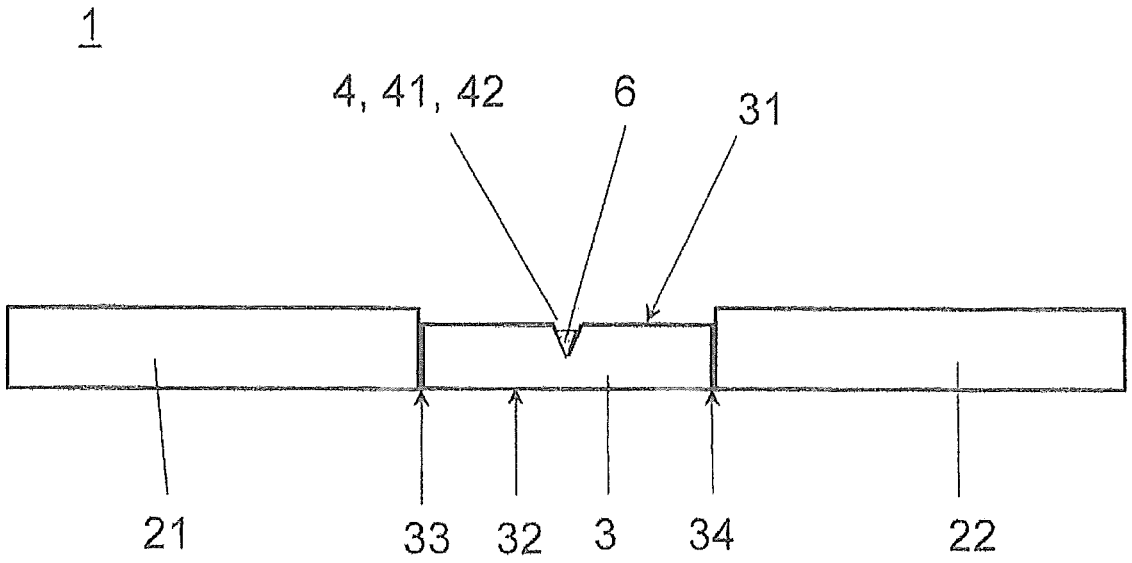
FIG. 9 shows a side view of a resistor assembly with a solder-filled groove.

FIG. 9 shows a side view of a resistor assembly 1 with a groove 42 that is partially filled with solder 6. This is a further development of the embodiment shown in FIG. 5 and FIG. 6. The solder 6 present in the groove 42 allows the end of an electrical conductor to be connected to the resistor element 3 without additional effort.

The features described in each of the embodiments shown can be combined with each other and modified. For example, both raised shaped elements and shaped elements embodied as recesses, in particular as grooves, can be provided next to each other on a resistor element.

The invention claimed is:

1. A resistor assembly comprising:

at least two connector elements; and at least one resistor element arranged between the at least two connector elements, the at least one resistor element having an upper side, a lower side and two longitudinal sides running parallel to each other, the at least one resistor element comprising a material having an electrical conductivity lower than an electrical conductivity of a material of the at least two connector elements, the at least one resistor element having, on at least the upper side or on at least the lower side, at least one shaped element as a positioning aid, the at least one shaped element comprising a recess in the material of the at least one resistor element for receiving an end of an electrical conductor.

2. The resistor assembly according to claim 1, wherein the recess is a groove extending parallel to the two longitudinal sides of the at least one resistor element.

3. The resistor assembly according to claim 2, wherein the groove has a cross-section in the shape of a V.

4. The resistor assembly according to claim 1, wherein the recess is at least partially filled with solder.

5. The resistor assembly according to claim 1, wherein the recess is arranged centrally between the two longitudinal sides of the at least one resistor element.

6. A method for producing a resistor assembly according to claim 1, wherein the method comprises the following steps:

providing a first strip made of a first material, the first strip having an upper side, a lower side and two longitudinal sides, the first strip having, at least on an upper side or at least on a lower side, at least one shaped element, the at least one shaped element being a recess;

setting a width of the first strip;

longitudinal seam welding the first strip on each of its two longitudinal sides with a further strip made of a material of which an electrical conductivity is greater than an electrical conductivity of the first material, thus forming a material composite; and cutting the material composite to produce a resistor assembly, a resistor element of the resistor assembly being formed from the material of the first strip.

7. A method for producing a resistor assembly according to claim 1, wherein the method comprises the following steps:

providing a first strip made of a first material, the first strip having an upper side, a lower side and two longitudinal sides;

setting a width of the first strip;

forming at least one shaped element on at least the upper side or on at least the lower side of the first strip, the at least one shaped element being a recess;

longitudinal seam welding the first strip on each of its two longitudinal sides with a further strip made of a material of which an electrical conductivity is greater than an electrical conductivity of the first material, thus forming a material composite; and cutting the material composite to produce a resistor assembly, a resistor element of the resistor assembly being formed from the first material of the first strip.

8. A method for producing a resistor assembly including at least two connector elements and at least one resistor element arranged between the at least two connector elements, wherein the method comprises the following steps:

providing a first strip made of a first material, the first strip having an upper side and a lower side and two longitudinal sides;

setting a width of the first strip;

forming at least one shaped element as a positioning aid on at least the upper side or on at least the lower side of the first strip;

longitudinal seam welding the first strip on each of its two longitudinal sides with respective further strips each made of a second material of which an electrical conductivity is greater than an electrical conductivity of the first material, thus forming a material composite; and cutting the material composite to produce the resistor assembly, the at least one resistor element of the resistor assembly being formed from the first material of the first strip and the at least two connector elements being respectively formed from the second material of the further strips.

9. A resistor assembly comprising:

at least two connector elements; and at least one resistor element arranged between the at least two connector elements, the at least one resistor element having an upper side, a lower side and two longitudinal sides running parallel to each other, the at least one resistor element comprising a material of which an electrical conductivity is lower than an electrical conductivity of a material of the at least two connector elements, the at least one resistor element having, on at least the upper side thereof or on at least the lower side thereof, at least one shaped element as a positioning aid, the at least one shaped element comprising an elevation constructed of the material of the at least one resistor element, the elevation having a height and projecting beyond a flat surface of the upper side or beyond a flat surface of the lower side.

10. The resistor assembly according to claim 9, wherein the elevation is at least partially coated with solder.

11. The resistor assembly according to claim 9, wherein the material of the elevation is monolithically bonded to the material of the at least one resistor element.

12. The resistor assembly according to claim 9, wherein the height of the elevation is such that a region of the elevation protrudes beyond the at least two connector elements.

13. The resistor assembly according to claim 9, wherein the elevation is cylindrical or conical in shape.

14. The resistor assembly according to claim 9, wherein the elevation is triangular in shape and extends parallel to the two longitudinal sides of the at least one resistor element along an entire length thereof.

15. The resistor assembly according to claim 9, wherein the elevation is a ridge and extends parallel to the two longitudinal sides of the at least one resistor element along an entire length thereof.

16. The resistor assembly according to claim 9, wherein the elevation is disposed centrally between the two longitudinal sides of the at least one resistor element.

17. A method for producing a resistor assembly according to claim 9, wherein the method comprises the following steps:

providing a first strip made of a first material, the first strip having an upper side, a lower side and two longitudinal sides;

setting a width of the first strip;

forming at least one shaped element from the first material of the first strip on at least the upper side or on at least the lower side, the at least one shaped element being an elevation having a height and projecting beyond a flat surface of the upper side or beyond a flat surface of the lower side;

longitudinal seam welding the first strip on each of its two longitudinal sides with a further strip made of a material of which an electrical conductivity is greater than an electrical conductivity of the first material, thus forming a material composite; and cutting the material composite to produce a resistor assembly, a resistor element of the resistor assembly being formed from the first material of the first strip.

18. A method for producing a resistor assembly according to claim 9, wherein the method comprises the following steps:

providing a first strip made of a first material, the first strip having an upper side, a lower side and two longitudinal sides, the first strip having, at least on the upper side or at least on the lower side, at least one shaped element, the at least one shaped element being an elevation having a height and projecting beyond a flat surface of the upper side or beyond a flat surface of the lower side;

setting the width of the first strip;

longitudinal seam welding the first strip on each of its two longitudinal sides with a further strip made of a material of which an electrical conductivity is greater than an electrical conductivity of the first material, thus forming a material composite; and cutting the material composite to produce a resistor assembly, a resistor element of the resistor assembly being formed from the first material of the first strip.

* * * * *